US010163424B2

(12) United States Patent
Colas

(10) Patent No.: US 10,163,424 B2
(45) Date of Patent: Dec. 25, 2018

(54) OFFSET COMPENSATED TELE-STYLE SADDLE

(71) Applicant: ADVANCED PLATING, INC., Nashville, TN (US)

(72) Inventor: Jeremy Colas, Murfreesboro, TN (US)

(73) Assignee: ADVANCED PLATING, INC., Nashville, TN (US)

( * ) Notice: Subject to any disclaimer, the term of this patent is extended or adjusted under 35 U.S.C. 154(b) by 0 days.

(21) Appl. No.: 15/644,103

(22) Filed: Jul. 7, 2017

(65) Prior Publication Data

US 2018/0012576 A1 Jan. 11, 2018

Related U.S. Application Data

(60) Provisional application No. 62/359,937, filed on Jul. 8, 2016.

(51) Int. Cl.
*G10D 3/04* (2006.01)
*G10D 1/08* (2006.01)

(52) U.S. Cl.
CPC ..... *G10D 3/04* (2013.01); *G10D 1/085* (2013.01)

(58) Field of Classification Search
CPC ..... G10D 3/04; G10D 1/085
USPC ..... 84/298
See application file for complete search history.

(56) References Cited

U.S. PATENT DOCUMENTS 2,918,837 A * 12/1959 Webster ..... G10D 3/04 84/312 R
3,437,001 A * 4/1969 Kraft ..... G10D 3/146 84/312 R
3,580,124 A * 5/1971 Mancini ..... G10D 3/14 84/313
4,031,799 A * 6/1977 Fender ..... G10D 3/04 84/298
4,281,576 A * 8/1981 Fender ..... G10D 3/04 84/298
4,385,543 A * 5/1983 Shaw ..... G10D 3/04 84/298
4,487,100 A * 12/1984 Storey ..... G10D 3/146 84/299
4,491,051 A * 1/1985 Barcus ..... G10H 3/143 84/728
4,541,320 A * 9/1985 Sciuto ..... G10D 3/12 84/298
4,625,613 A * 12/1986 Steinberger ..... G10D 3/14 84/267
4,656,915 A * 4/1987 Osuga ..... G10D 3/146 84/297 R
4,867,031 A * 9/1989 Fender ..... G10D 3/146 84/313
5,173,565 A * 12/1992 Gunn ..... G10D 3/04 84/298

(Continued)

FOREIGN PATENT DOCUMENTS

JP 2011-197618 10/2011

*Primary Examiner* — David Warren
*Assistant Examiner* — Christina Schreiber
(74) *Attorney, Agent, or Firm* — Greenblum & Bernstein, P.L.C.

(57) ABSTRACT

A stringed-instrument saddle having two string paths, each string path configured to accommodate a string, wherein the two string paths are offset from one another by an offset distance in a direction of string travel.

22 Claims, 16 Drawing Sheets

(56) References Cited

U.S. PATENT DOCUMENTS 5,260,504 A * 11/1993 Turner ..... G10D 3/04 84/297 R
5,285,710 A * 2/1994 Chapman ..... G10D 3/04 84/307
5,429,028 A * 7/1995 Fisher, IV ..... G10D 3/146 84/313
5,739,444 A * 4/1998 Borisoff ..... G10D 3/143 84/267
6,426,454 B1 * 7/2002 Gregory ..... G10D 1/00 84/267
6,613,968 B1 * 9/2003 Devereaux ..... G10D 3/04 84/298
6,686,523 B1 * 2/2004 Devereaux ..... G10D 3/04 84/290
6,822,156 B1 * 11/2004 Lazarus ..... G10H 3/18 84/731
8,723,007 B2 * 5/2014 Tracy ..... G10D 3/04 84/307
8,816,177 B2 * 8/2014 Goto ..... G10D 3/04 84/298
9,812,099 B1 * 11/2017 Nackard ..... G10D 3/146
2003/0164081 A1 * 9/2003 Booker ..... G10D 3/06 84/314 R
2006/0162528 A1 * 7/2006 Kinoshita ..... G10D 3/04 84/298
2007/0012159 A1 * 1/2007 Babicz ..... G10D 3/12 84/307
2009/0314152 A1 * 12/2009 Shamblin ..... G10D 3/146 84/313
2010/0000392 A1 * 1/2010 Uberbacher ..... G10D 3/146 84/313
2010/0005944 A1 * 1/2010 Eliasson ..... G10D 3/12 84/314 N
2010/0275756 A1 * 11/2010 Woodland ..... G10D 3/04 84/307
2010/0319514 A1 * 12/2010 Aires ..... G10D 3/04 84/298
2011/0259171 A1 * 10/2011 Babicz ..... G10D 3/04 84/298
2013/0055876 A1 * 3/2013 Mason ..... G10D 3/04 84/298
2013/0186225 A1 7/2013 McCabe
2013/0186255 A1 * 7/2013 McCabe ..... G10D 3/146 84/313
2014/0150625 A1 * 6/2014 Miltimore ..... G10D 1/08 84/267
2014/0196590 A1 * 7/2014 Glaser, II ..... G10D 3/06 84/453
2015/0340017 A1 * 11/2015 Stroh ..... G10D 3/04 84/298
2016/0163294 A1 * 6/2016 Martin ..... G10D 1/08 84/267
2018/0012576 A1 * 1/2018 Colas ..... G10D 1/085
2018/0033413 A1 * 2/2018 Glaser, II ..... G10D 3/06
2018/0040311 A1 * 2/2018 Lyles ..... G10D 3/04

* cited by examiner

OFFSET COMPENSATED TELE-STYLE SADDLE

CROSS REFERENCE TO RELATED APPLICATION

The present application claims the benefit of U.S. Provisional Application No. 62/359,937, filed Jul. 8, 2016, the contents of which are expressly incorporated herein by reference in its entirety.

BACKGROUND OF THE DISCLOSURE

1. Field of the Disclosure

This disclosure relates to guitar bridges, and more particularly to an offset compensated telecaster (or tele) saddle for a guitar bridge.

2. Description of the Related Art

The Fender Telecaster (or Tele), is the world's first commercially successful solid-body electric guitar, and was introduced for national distribution (as the Broadcaster) in the autumn of 1950. In its classic form, the guitar is simply constructed, with the neck and fingerboard comprising a single piece of maple, screwed to an ash or alder body inexpensively jigged with flat surfaces on the front and back. The hardware includes two single coil pickups controlled by a three-way selector switch, and one each of volume and tone controls. The bridge has three adjustable saddles, with strings doubled up on each.

Traditionally, telecaster saddles were made of 5/16" raw brass bar stock or 1/4" steel bar stock (i.e., cylindrical stock) from 1950 until the mid-50's (roughly 1955). The saddles were straight across (i.e., had a smooth surface) and did not have any grooves for the string to rest in. This caused at least two major issues for conventional telecaster saddles.

Firstly, these saddles provided no compensation for intonation. Several factors affect fretted instrument intonation, including depth of the string slots in the nut, bridge saddle position, the position of the frets themselves, and the technique of the musician. On fretted string instruments, pushing a string against a fret, aside from raising the string's pitch because it shortens the string, also causes a slight secondary raise in pitch because pushing the string increases its tension. If the instrument does not compensate for this with a slight increase in the distance from the bridge saddle to the fret, the note sounds sharp.

Secondly, with conventional tele saddles, strings had a tendency to slip and fall into the set screw holes or between the threads of the set screws (especially in the high-E string), which would cause an undesirous "sitar"-like buzzing effect, or in some cases would break the string. Moreover, the saddles were not well adapted for B-benders or Bigsby users, which required smooth travel of the strings over the saddles as the string(s) are further tensioned.

Fender switched to using threaded bar stock (e.g., a threaded cylinder) in the late 50's/early 60's. The saddles made from threaded bar stock did provide the saddle a string path, but because the threads were angled (due to conventional thread angle of the threaded bar stock), these saddles did not provide a straight path for the string, resulting in, for example, incorrect string spacing. Additionally, due to the location of the set screws in these saddles, the high-E string would still fall into the set screw hole and/or be pinched in the threading of the set screw. These saddles also did not compensate for intonation.

The issues the traditional tele style saddles present are issues for any telecaster player with a vintage or vintage style telecaster. There are a number of compensated telecaster saddles made through the years, for example, from ones that are just an angled standard style saddle or ones that have compensation built into a crest on the top. While some of these designs worked, some did not, they all had certain "design flaws" that people would just live with. These design flaws include: (1) almost none fixed the issue of the string falling into the set screw hole; (2) despite having "compensation," the intonation was never actually correct; (3) certain saddles having the compensation built into the crest either did not have a long life (e.g., the string would dig into the sharper peek causing the string to buzz, or in some cases break), the intonation was not very accurate and/or these saddles did not look aesthetically pleasing while on the guitar; (4) the saddles included set screws that rode on a razor's edge and would cut into the bridge plate; (6) none of these saddles work well with B benders or Bigsby equipped guitars; (7) none of these saddles is easily conducive to left hand guitars without the need for purchasing extra saddles to make a set; and (8) none of these saddles works well with higher action, such as a guitar with a shallow neck set or with a tremolo system, and would buzz and become even more inaccurate in intonation.

Therefore, there is a need for an improved saddle for a telecaster (or tele) style guitar bridge that solves these above-noted deficiencies, provides improved performance and improved compensation for intonation.

SUMMARY OF THE EMBODIMENTS OF THE DISCLOSURE

Aspects of the present disclosure are directed to improved saddle for a telecaster (or tele) style guitar bridge that provides improved performance and compensation for intonation. With embodiments of the present disclosure, the string is prevented from falling into the set screw hole; the compensation provides for accurate intonation, the saddles look aesthetically pleasing while on the guitar, the saddles include set screws configured to be arranged at a variety of angles so as to provide a secure connection and does not cut into the bridge plate. Additionally, the saddles of the present disclosure work well with B benders or Bigsby equipped guitars, and are easily conducive to left hand guitars without the need for purchasing extra saddles to make a set. Furthermore, the saddles of the present disclosure work well with higher action, such as a guitar with a shallow neck set or with a tremolo system.

Aspects of the present disclosure are directed to a stringed-instrument saddle, comprising two string paths. Each string path is configured to accommodate a string and the two string paths are offset from one another by an offset distance in a direction of string travel.

In further embodiments, the stringed-instrument saddle extends in a longitudinal direction, which is perpendicular to the direction of string travel, and the stringed-instrument saddle further comprises two threaded height adjustment holes arranged on respective ends of the stringed-instrument saddle beyond respective string paths in the longitudinal direction.

In additional embodiments, the saddle further comprises a threaded length adjustment hole arranged between the two string paths in the longitudinal direction.

In embodiments, the two threaded height adjustment holes are perpendicular to the threaded length adjustment hole.

In yet further embodiments, the two string paths each comprise a groove.

In further embodiments, the two string paths each comprise a v-shaped groove.

In additional embodiments, the saddle further comprises a first approximately-cylindrical portion and a second approximately-cylindrical portion, wherein the first approximately-cylindrical portion is offset from the second approximately-cylindrical portion by the offset distance.

In embodiments, a first string path of the two string paths is arranged on the first approximately-cylindrical portion and a second string path of the two string paths is arranged on the second approximately-cylindrical portion.

In certain embodiments, the first approximately-cylindrical portion and the second approximately-cylindrical portion each have a diameter of approximately 0.247 inches.

In some embodiments, the first approximately-cylindrical portion and the second approximately-cylindrical portion each have a diameter of approximately 0.313 inches.

In additional embodiments, the first approximately-cylindrical portion comprises a first threaded height adjustment hole and the second approximately-cylindrical portion comprises a second threaded height adjustment hole.

In embodiments, the saddle further comprises an approximately oval cylindrical portion arranged between the first approximately-cylindrical portion and the second approximately-cylindrical portion.

In yet further embodiments, the approximately oval cylindrical portion has a height equal to the diameter of the first and second approximately-cylindrical portions and has a width equal to the diameter of the first and second approximately-cylindrical portions plus the offset distance.

In further embodiments, the approximately oval cylindrical portion comprises a threaded length adjustment hole.

In embodiments, the offset distance is operable to provide string intonation compensation for accommodated strings.

In further embodiments, the offset distance is approximately 0.043 inches.

Additional aspects of the disclosure are directed to a stringed-instrument saddle assembly comprising the stringed-instrument saddle and a height adjustment screw arranged in each of the two threaded height adjustment holes.

In further embodiments, the height adjustment screw comprises a rounded-tip end configured for contact with a surface of a stringed-instrument or a bridge plate arrangable on a stringed-instrument.

In additional embodiments, the height adjustment screws having the rounded-tip end are operable to provide an approximately constant amount of contact with the surface of the stringed-instrument or the bridge plate through a range of saddle orientation angles.

Additional aspects of the disclosure are directed to a bridge assembly comprising three stringed-instrument saddles, wherein two of the stringed-instrument saddles are arranged in a same offset orientation, and a third of the stringed-instrument saddles is arranged with an opposite offset orientation between the two of the stringed-instrument saddles.

BRIEF DESCRIPTION OF THE DRAWINGS

The novel features which are characteristic of the systems, both as to structure and method of operation thereof, together with further aims and advantages thereof, will be understood from the following description, considered in connection with the accompanying drawings, in which embodiments of the system are illustrated by way of example. It is to be expressly understood, however, that the drawings are for the purpose of illustration and description only, and they are not intended as a definition of the limits of the system. For a more complete understanding of the disclosure, as well as other aims and further features thereof, reference may be had to the following detailed description of the embodiments of the disclosure in conjunction with the following exemplary and non-limiting drawings wherein.

Figure 1:
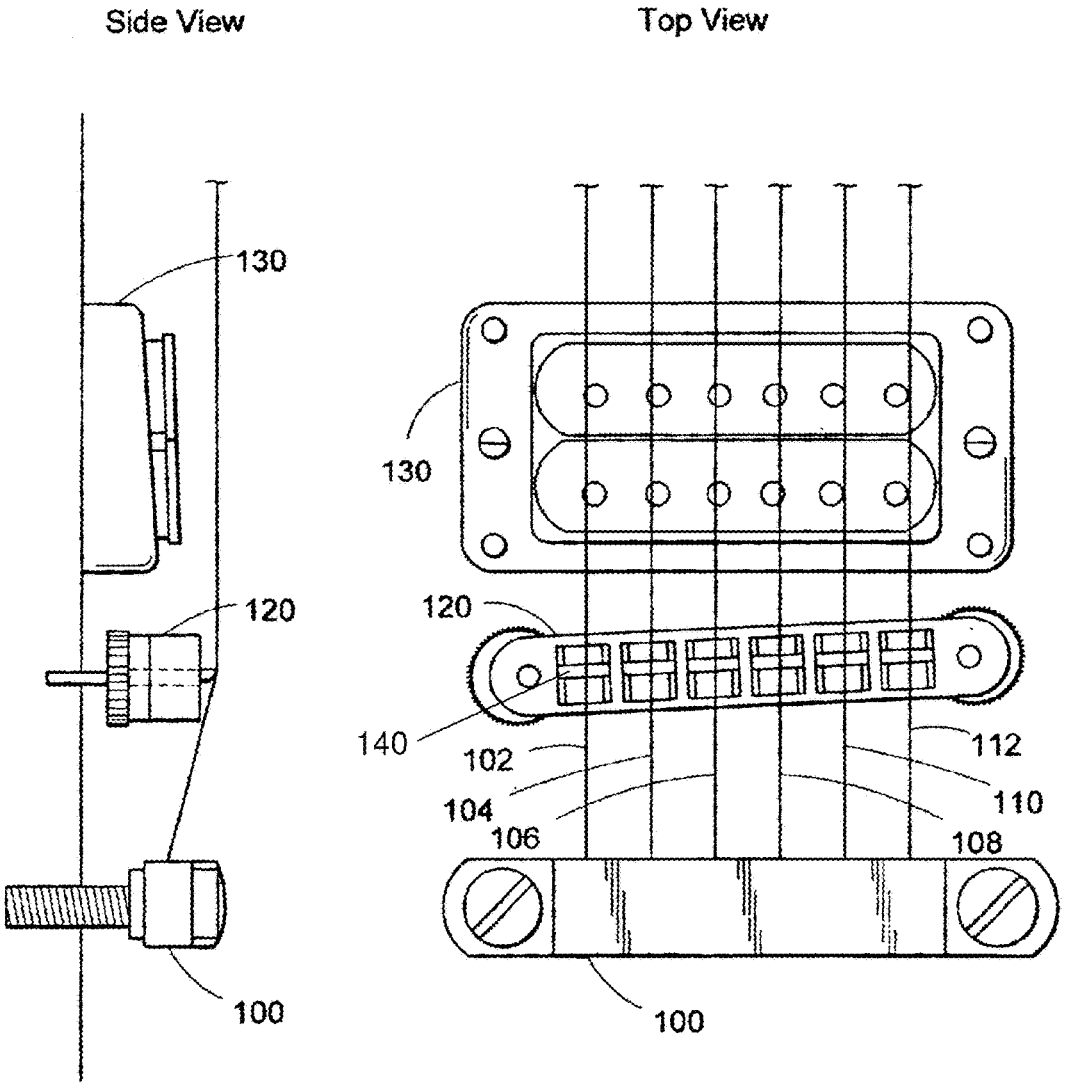
Figure 1 (Prior Art)
FIG. 1 is a top and side view of a conventional guitar upon which a guitar bridge (a non-tele-style bridge) is mounted.

Reference numbers refer to the same or equivalent parts of the present disclosure throughout the various figures of the drawings.

DETAILED DESCRIPTION OF THE EMBODIMENTS OF THE DISCLOSURE

In the following description, the various embodiments of the present disclosure will be described with respect to the enclosed drawings. As required, detailed embodiments of the embodiments of the present disclosure are discussed herein; however, it is to be understood that the disclosed embodiments are merely exemplary of the embodiments of the disclosure that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded.

Except where otherwise indicated, all numbers expressing quantities used in the specification and claims are to be understood as being modified in all instances by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range (unless otherwise explicitly indicated). For example, if a range is from about 1 to about 50, it is deemed to include, for example, 1, 7, 34, 46.1, 23.7, or any other value or range within the range.

As used herein, the indefinite article "a" indicates one as well as more than one and does not necessarily limit its referent noun to the singular.

As used herein, the terms "about" and "approximately" indicate that the amount or value in question may be the specific value designated or some other value in its neighborhood. Generally, the terms "about" and "approximately" denoting a certain value is intended to denote a range within±5% of the value. As one example, the phrase "about 100" denotes a range of 100±5, i.e. the range from 95 to 105. Generally, when the terms "about" and "approximately" are used, it can be expected that similar results or effects according to the disclosure can be obtained within a range of ±5% of the indicated value.

As used herein, the term "and/or" indicates that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20° from parallel alignment and the term "substantially perpendicular" refers to deviating less than 20° from perpendicular alignment. The term "parallel" refers to deviating less than 5° from mathematically exact parallel alignment. Similarly "perpendicular" refers to deviating less than 5° from mathematically exact perpendicular alignment.

The term "at least partially" is intended to denote that the following property is fulfilled to a certain extent or completely.

The terms "substantially" and "essentially" are used to denote that the following feature, property or parameter is either completely (entirely) realized or satisfied or to a major degree that does not adversely affect the intended result.

The term "comprising" as used herein is intended to be non-exclusive and open-ended. Thus, for instance a composition comprising a compound A may include other compounds besides A. However, the term "comprising" also covers the more restrictive meanings of "consisting essentially of" and "consisting of", so that for instance "a composition comprising a compound A" may also (essentially) consist of the compound A.

The various embodiments disclosed herein can be used separately and in various combinations unless specifically stated to the contrary.

Embodiments of the present disclosure provide an offset compensated tele-style saddle having an asymmetrical design. In embodiments, the saddles have a 0.043" offset and v-groove notch string paths which have an open angle of 100.8°, a width of 0.066", and a depth of 0.027". In accordance with aspects of the disclosure, the saddles include set screws having a rounded tip so as to provide a more secure contact with the guitar.

The present disclosure also provides for improving the sound from the guitar by creating a more solidly mounted system for coupling the strings to a resonating guitar body. The solid connection afforded by the disclosed embodiments allows for the guitar instrument to resonate better, thus transferring the sound to the instrument body and enhancing the played notes. The sound quality is also enhanced due to the solid adjustment of the bridge components allowing for increased harmonic overtone transfer to the instrument pickups.

As noted above, conventional tele saddles all had certain "design flaws" that people would just live with. In the past, users have just accepted these above-noted drawbacks as a "feature" of a vintage style telecaster. Through a deep study of tele-style bridges and saddles, the inventor of the present application discovered that these issues and drawbacks were not due to the guitar itself, but due to the saddles. In view of these drawbacks, the inventor set out to provide an improved tele-style saddle, namely an offset compensated tele-style saddle.

FIG. 1 is a top and side view of a conventional guitar upon which a guitar bridge (a non-tele-style bridge) is mounted. As shown in FIG. 1, a tailpiece 100 is mounted on a body of an exemplary 6-string guitar and holds one end of strings 102, 104, 106, 108, 110, and 112. With this non-tele-style bridge, a tailpiece 100 provides the mechanical strength for the tension of the stretched strings against the body of the guitar. These strings 102, 104, 106, 108, 110, and 112 then pass over a bridge 120, which is used to initially set the tuning of the guitar so the guitar plays in tune with the proper tone and timbre. The bridge includes a number of saddles (e.g., one or two for each string), wherein each string passes (or two strings pass) over a respective saddle. (It should be noted, as would be understood by the ordinarily-skilled artisan, that the saddles depicted in FIG. 1 are not tele-style saddles.) Each saddle may be similarly constructed and may include one or more notches, through which the string passes to hold its respective string above the bridge and guitar at a desired height. Alternatively, in embodiments, the saddle may have no notches at all. The position of each saddle (within the bridge) along the length of the guitar (i.e., in a string extension direction) may be altered to adjust the intonation of each string.

As shown in FIG. 1, in an electric guitar, the strings 102, 104, 106, 108, 110, and 112 will also pass over one or more magnetic or other types of pickups 130. The pickups 130 are used to convert the physical vibrations of the strings 102, 104, 106, 108, 110, and 112 into electrical signals that can then be electrically amplified.

The strings 102, 104, 106, 108, 110, and 112 then extend over, but do not contact, multiple frets (not shown) on the guitar. Towards a neck of the guitar, the strings 102, 104, 106, 108, 110, and 112 then pass over a nut (not shown) to tuning pegs (not shown). The tuning pegs are adjustable to increase or decrease the tension of each respective string 102, 104, 106, 108, 110, and 112. This raises or lowers the frequency of the tone of each string so that the proper notes are heard upon plucking or strumming the guitar. Between the nut and the bridge 120 are the various frets between which the strings 102, 104, 106, 108, 110, and 112 are depressed so that the effective length of the string is shortened to thereby increase the frequency at which that particular string vibrates.

An important factor in a quality electric guitar is the guitar sound. The material of the body, the quality of the magnetic or other pickups (e.g., piezo pickups), the rigidity of the guitar itself, the accuracy of the placement and spacing of the strings 102, 104, 106, 108, 110, and 112 above the fingerboard and associated frets, the actual placement of the frets, and the quality of the tuning bridge 120 are all important to the overall sound of the guitar.

The strings 102, 104, 106, 108, 110, and 112 are stretched initially between the bridge 120 and the nut (not shown) just to tune the strings 102, 104, 106, 108, 110, and 112 to their proper respective note. Then the strings 102, 104, 106, 108, 110, and 112 are stressed further by a guitar player, upon playing, by forcing the strings 102, 104, 106, 108, 110, and 112 down onto the fingerboard between frets.

Figure 2:
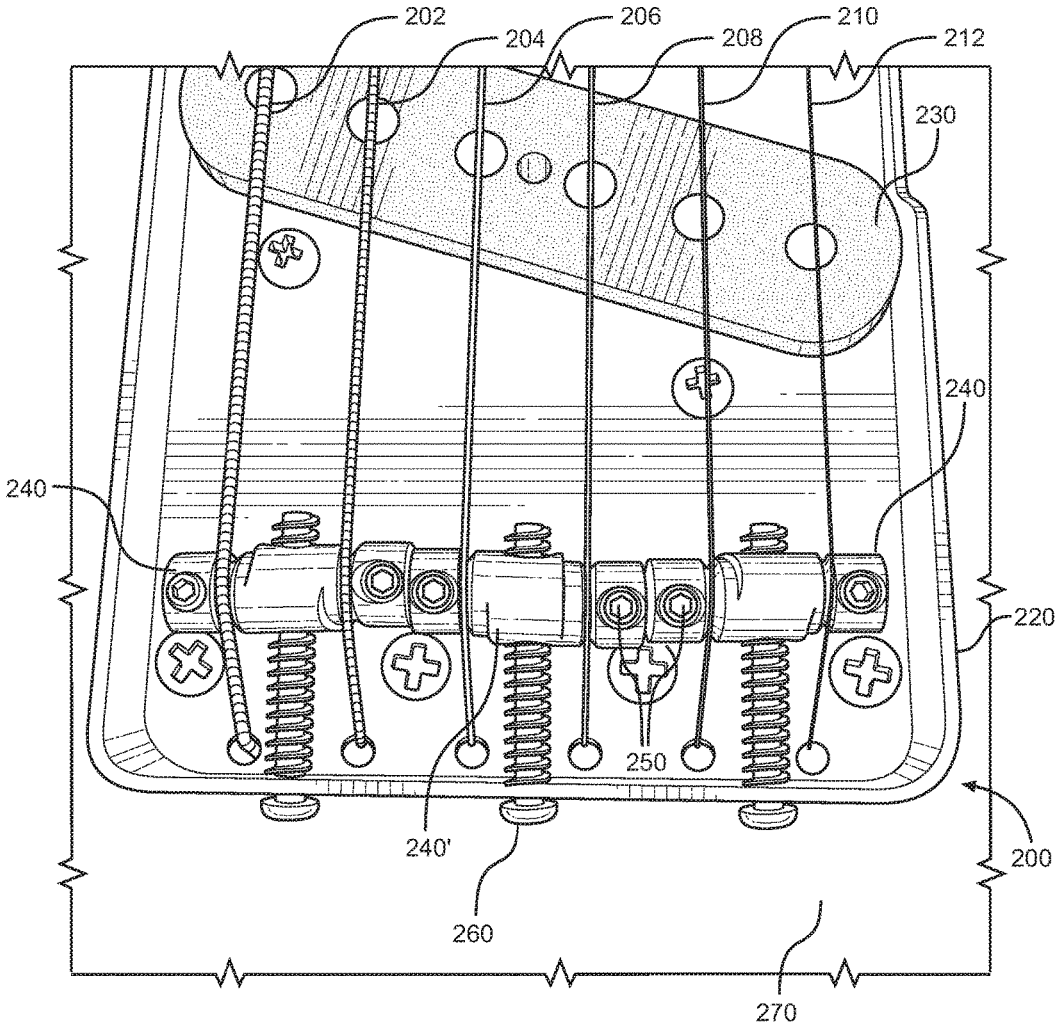
FIG. 2 is a top view of a tele-style guitar upon which a tele-style bridge is mounted having three tele-style saddles in accordance with aspects of the present disclosure.

FIG. 2 is a top view 200 of a tele-style guitar 270 upon which a tele-style bridge 220 (or bridge plate) is mounted having three tele-style saddles 240, 240' in accordance with aspects of the present disclosure. As shown in FIG. 2, the guitar bridge 220 includes saddles 240 on each side of the bridge 220 (or mounting plate) and saddle 240' in the middle of the bridge 220. As discussed further below, while (in most embodiments) saddle 240 and saddle 240' have an identical structure, as shown in the embodiment of FIG. 2, the orientation of saddle 240 is reversed as compared to saddle 240'. That is, the orientation of saddle 240 is flipped 180° as compared to saddle 240'. As (in most embodiments) saddle 240 and saddle 240' have an identical structure, throughout the specification, Applicants may refer to saddle 240, and unless stated to the contrary, the description of saddle 240 is also applicable to saddle 240'.

Each saddle 240 includes two holes structured and arranged to accommodate height adjustment screws 250, and one hole (orthogonally arranged relative to the two holes) structured and arranged to accommodate length adjustment screw 260 (or intonation screw). As is understood by the ordinarily skilled artisan, height adjustment screws 250 are used to move the saddle 240 vertically to adjust a height of each side of the saddle 240, so as to adjust a height of each string over the guitar. Additionally, the length adjustment screw 260 (or intonation screw) is used to move the saddle 240 longitudinally so as to adjust a string length between the saddle 240 and the nut (not shown) of the guitar.

Each saddle 240 is structured and arranged to accommodate two strings (e.g., 202 and 204, 206 and 208, and 210 and 212), which pass through the bridge 220 (or mounting plate) and over a respective saddle 240, and then over a nut (not shown) at an opposite end of the fret board (not shown). Each string passes over at least one pickup 230 (e.g., a magnetic or piezo pickup) arranged on the guitar 270, which captures the vibrations of the strings in order to produce an electric signal.

Figure 3A:
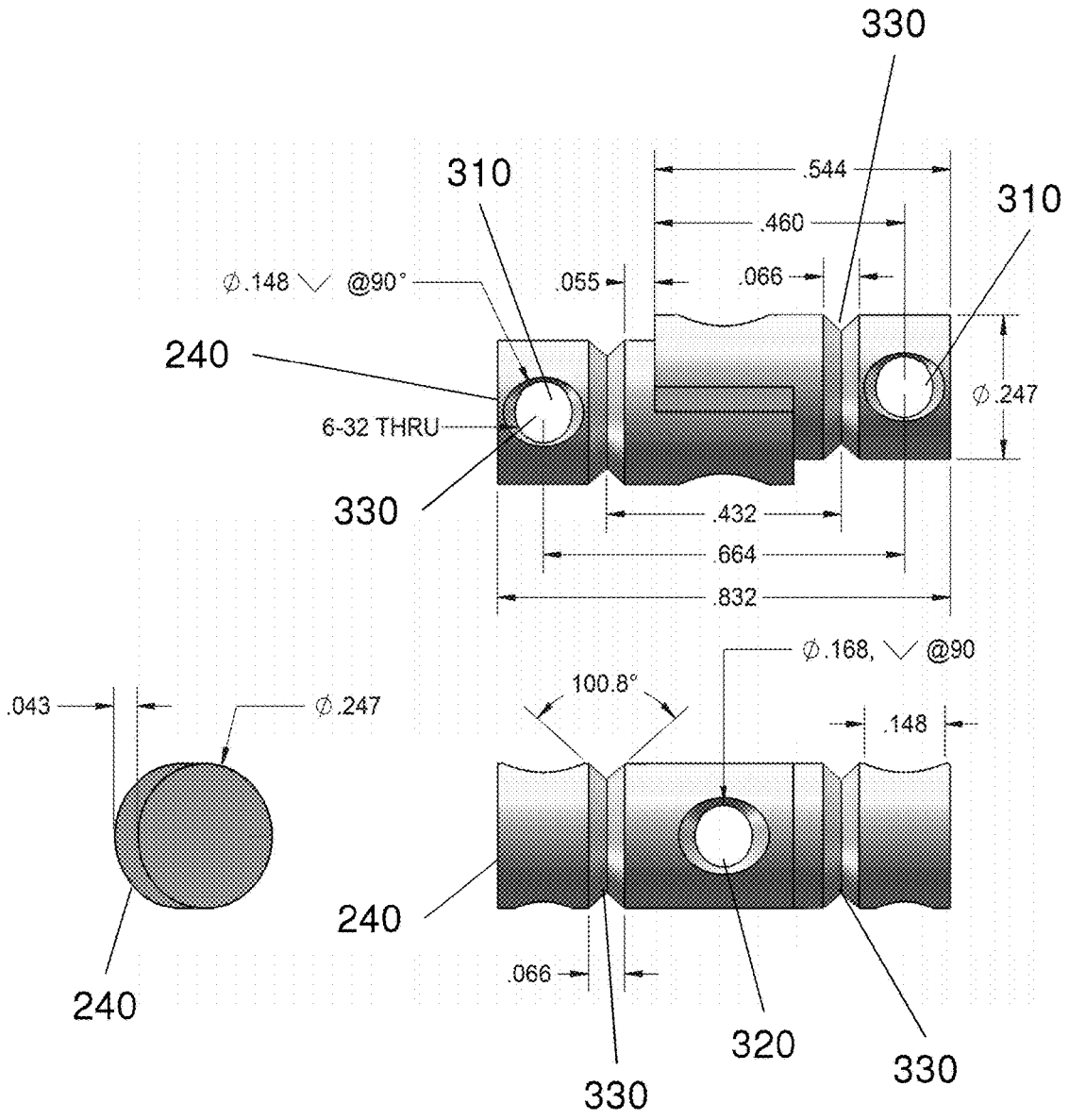
FIG. 3A illustrates top, side, and end views of an exemplary offset compensated telecaster (or tele) saddle without strings arranged thereon in accordance with aspects of the present disclosure.

FIG. 3A illustrates top, side, and end views of an exemplary and non-limiting offset compensated telecaster (or tele) saddle 240 without strings arranged thereon in accordance with aspects of the present disclosure. As shown in FIG. 3A, the saddle includes two threaded height adjustment holes 310 structured and arranged to accommodate and interact with height adjustment screws (not shown), and one threaded length adjustment hole 320 (orthogonally arranged relative to the two holes 310) structured and arranged to accommodate and interact with a length adjustment screw (not shown).

Each saddle 240 also includes two v-grooves 330 around the circumference of the saddle 240, each v-groove 330 structured and arranged to accommodate a string (not shown) therein. In accordance with aspects of the disclosure, the two v-grooves 330 of each saddle 240 are offset from one another by a distance of 0.043 inches. That is, each saddle 240 has an asymmetrical shape with a right side and a left side, and the right side is offset from the left side. When arranged on the guitar, for example as shown in FIG. 2, this offset in the saddle 240 results in the two strings passing over the saddle 240 to be longitudinally offset from one another, such that the longitudinal length of the two strings supported between the saddles and the nut (not shown) are different. In such a manner, in accordance with aspects of the disclosure, the saddle 240 compensates to provide more accurate intonation.

As shown in FIG. 3A, with this exemplary embodiment, a diameter of each half of the saddle is 0.247 inches (e.g., approximately ¼ inch), and the left side of the saddle is offset from the right side of the saddle by 0.043 inches. While each end of the saddle 240 has a circular profile (as shown in the side view), due to the offset configuration of the saddle 240, through a middle section, the saddle has an approximately oblong profile (as also shown in the side view).

Though intensive study, the inventor discovered this optimum offset distance of 0.043 inches provides optimum intonation compensation, amongst other advantages. For example, the inventor carefully measured the distance from the $12^{th}$ fret and from the back of the bridge plate to the exact contact area on the saddle where the string was intonated. The offset of the saddle 240 was configured to compensate for various fret board radii ranging from 7.25" to 9.5" and also as flat as a 12". These are the most commonly seen fretboard radii. The saddle 240 was also configured to compensate for varying string gauges ranging from 8-38 gauge all the way to 13-60 gauge to allow the saddles 240 to be utilized by players over a wide range of string gauges. Through this intensive study, it was discovered that an offset of 0.043" from string to string was optimum for compensating intonation all across the board of various string gauges and fretboard radii. Thus, while other offsets (e.g., approximately 0.043", such as 0.0425", larger than 0.043", such as 0.045" or less than 0.043", such as 0.041") are contemplated by the present disclosure, and may be useful with a particular player's set up (e.g., alternate tuning, very heavy string gauge), the inventor has discovered that an offset of 0.043" from string to string was optimum for compensating intonation all across the board of various string gauges and fretboard radii.

As also shown in FIG. 3A, each v-groove 330 has a width of 0.066 inches and an included angle of 100.8°. As discussed in further detail below, by utilizing a v-shaped groove (instead of a u-shaped) groove, the v-groove 330 provides two points of contact with a respective string, so as to provide a more stable contact between each string and the saddle 240. Through intensive study, the inventor discovered that if a string path in the form of a 100.8° v groove is utilized (instead of a U groove) all the way around the saddle 240, the same size groove could be used to accommodate all of the strings, thus making the saddles 240 more universal. Additionally, the two contact points for the string to sit on, provides a more secure contact, which eliminates buzzing from the string moving within the groove.

In embodiments, each saddle has an overall length of 0.832 inches, and the centers of the two height adjustment holes 310 are spaced 0.664 inches from one another. The height adjustment holes 310 and the length adjustment hole 320 have a diameter of 6/32". The centers of the v-grooves 330 are spaced 0.432 inches from each other.

Figure 3B:
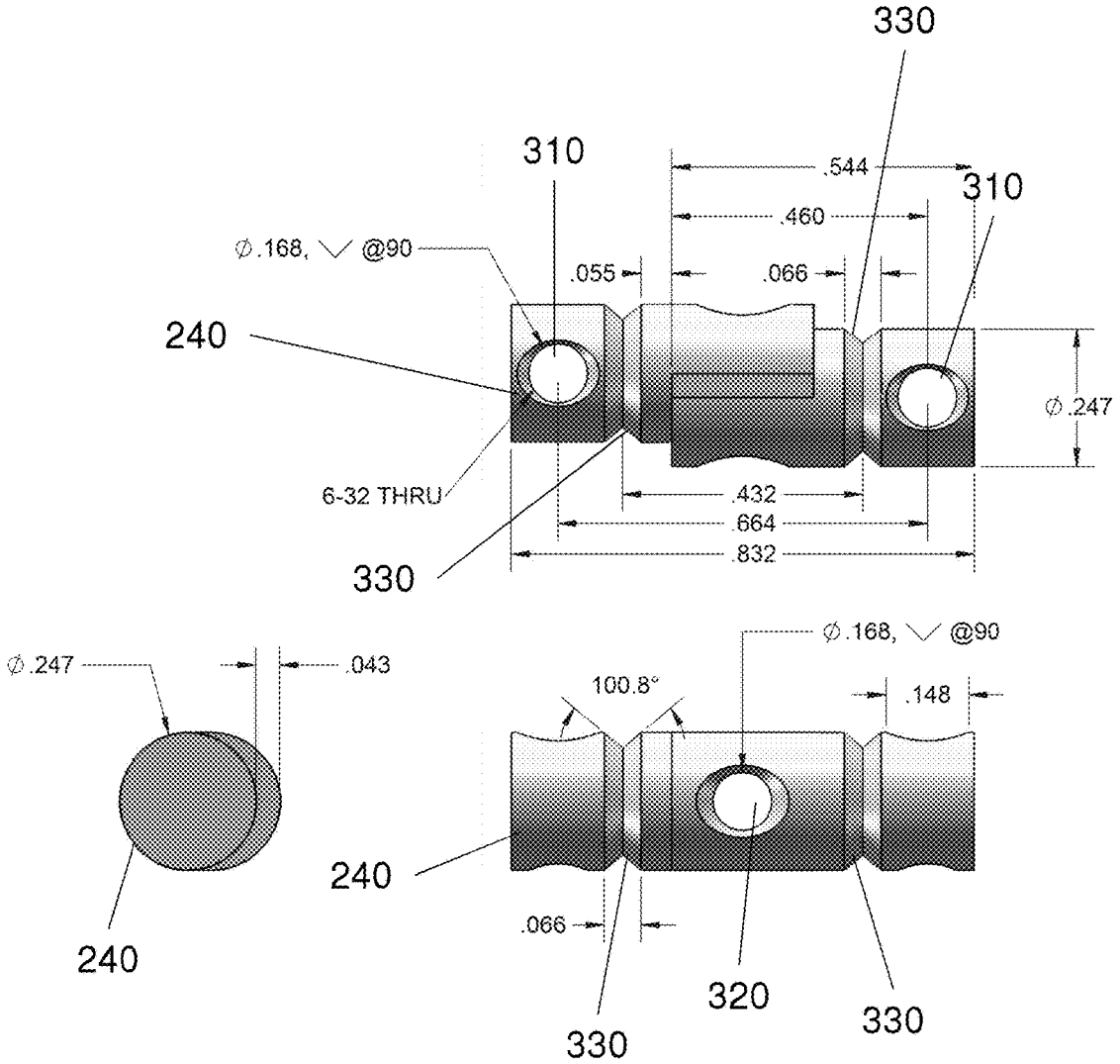
FIG. 3B illustrates top, side, and end views of an exemplary offset compensated telecaster (or tele) saddle without strings arranged thereon in accordance with aspects of the present disclosure.

FIG. 3B illustrates top, side, and end views of an exemplary offset compensated telecaster (or tele) saddle 240' without strings arranged thereon in accordance with aspects of the present disclosure. As noted above, in most embodiments, saddle 240 and saddle 240' are identical, with a flipped or reversed orientation. As such, the discussion of FIG. 3A applies to the saddle 240' of FIG. 3B. It is noted, that in embodiments, saddle 240' is used to support the two middle strings (e.g., "D" string and "G" string), and two saddles 240 are used to support the outer strings (e.g., "low E" string and "A" string on one saddle and "B" string and "high E" string on the other saddle). As discussed above, when arranged on the guitar, for example as shown in FIG. 2, the offsets in the saddles 240 results in the respective two strings passing over the saddle 240 to be longitudinally offset (in a string-extension direction) from one another, such that the longitudinal length of the two strings supported between the respective saddle and the nut (not shown) are different. In such a manner, in accordance with aspects of the disclosure, the saddles 240 compensate to provide more accurate intonation for each of the six strings on the guitar.

Figure 4A:
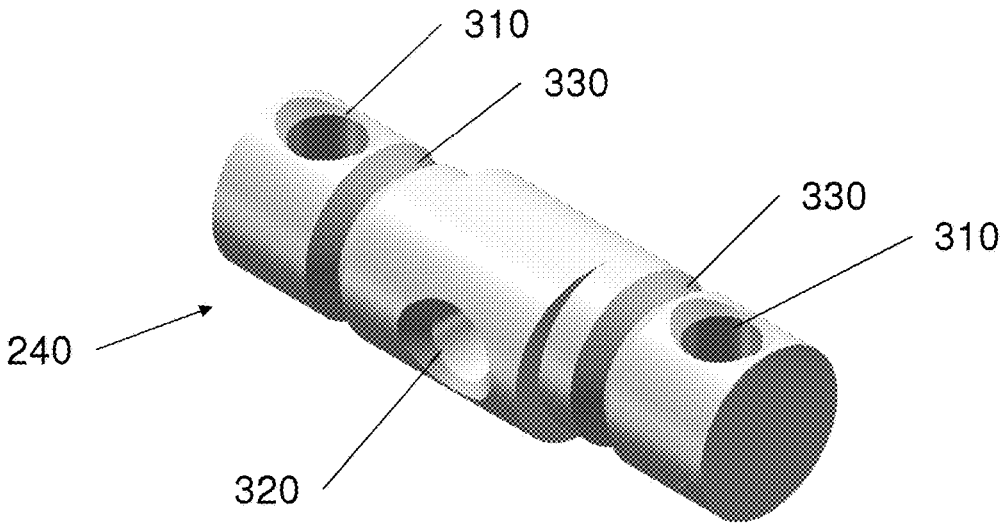
FIGS. 4A and 4B illustrate isometric views of an exemplary offset compensated telecaster (or tele) saddle in accordance with aspects of the present disclosure.
Figure 4B:
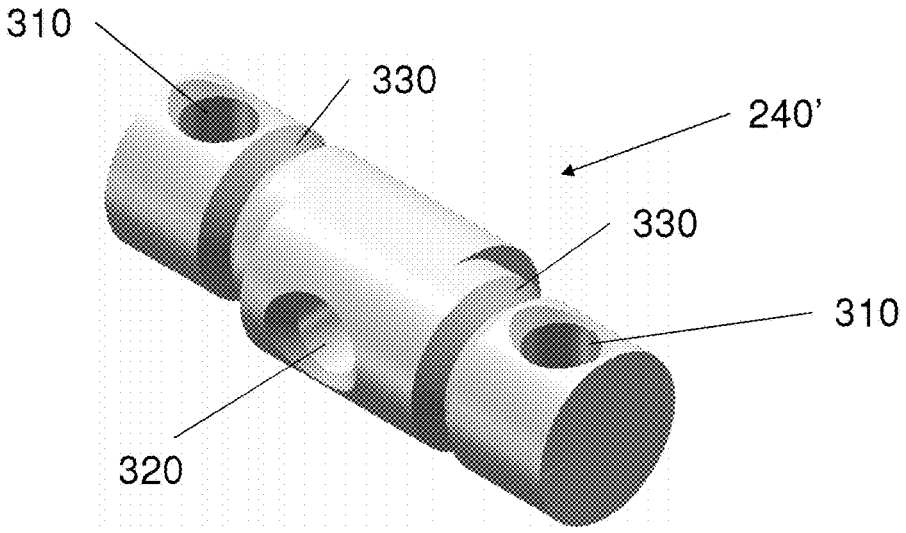

FIGS. 4A and 4B illustrate isometric views of an exemplary offset compensated telecaster (or tele) saddle 240, 240' in accordance with aspects of the present disclosure. As shown in FIG. 4A, for example, the saddle 240 includes two v-grooves 330, two height adjustment holes 310, and a length adjustment hole 320. As shown in FIG. 4B, the configuration of saddle 240' is the same as saddle 240, but due to the reversed orientation, the offset is oppositely oriented.

Figure 5:
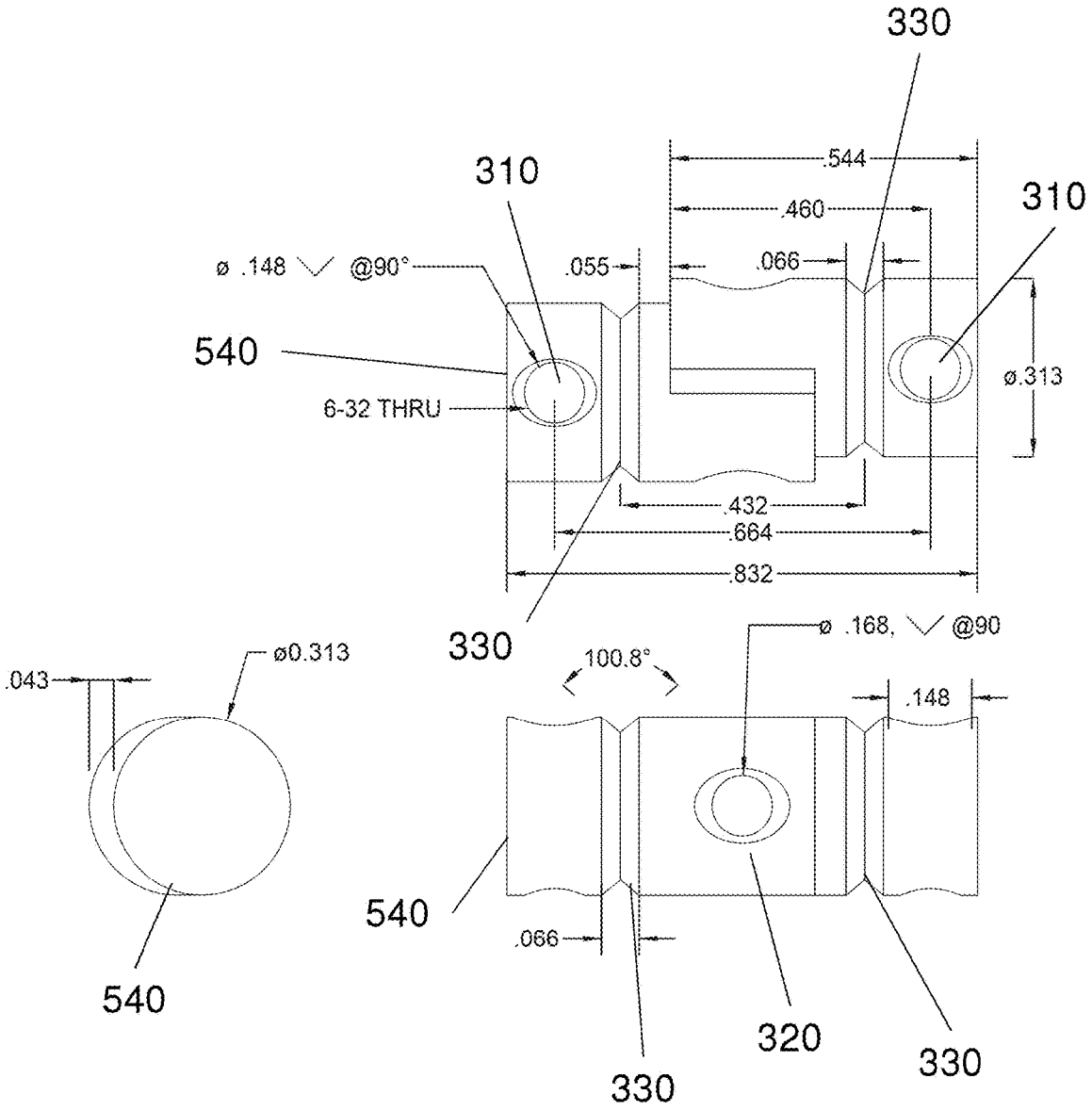
FIG. 5 illustrates top, side, and end views of an exemplary offset compensated telecaster (or tele) saddle without strings arranged thereon in accordance with aspects of the present disclosure.

FIG. 5 illustrates top, side, and end views of an further exemplary offset compensated telecaster (or tele) saddle 540 without strings arranged thereon in accordance with aspects of the present disclosure. In contrast to the embodiment of FIGS. 3A and 3B, which have a diameter of 0.247 inches (or, approximately ¼ inch), saddle 540 has a larger diameter of 0.313 inches (or, approximately 5/16 inch). Other than the overall diameter of the saddle 540, the other dimensions of saddle 540 are the same as those of saddle 240. Most importantly, the offset distance of 0.043 inches is the same for both saddle 540 and saddle 240. In accordance with aspects of the disclosure, saddle 540 may be used to provide an overall higher string height as compared to guitars having saddles 240.

Figure 6:
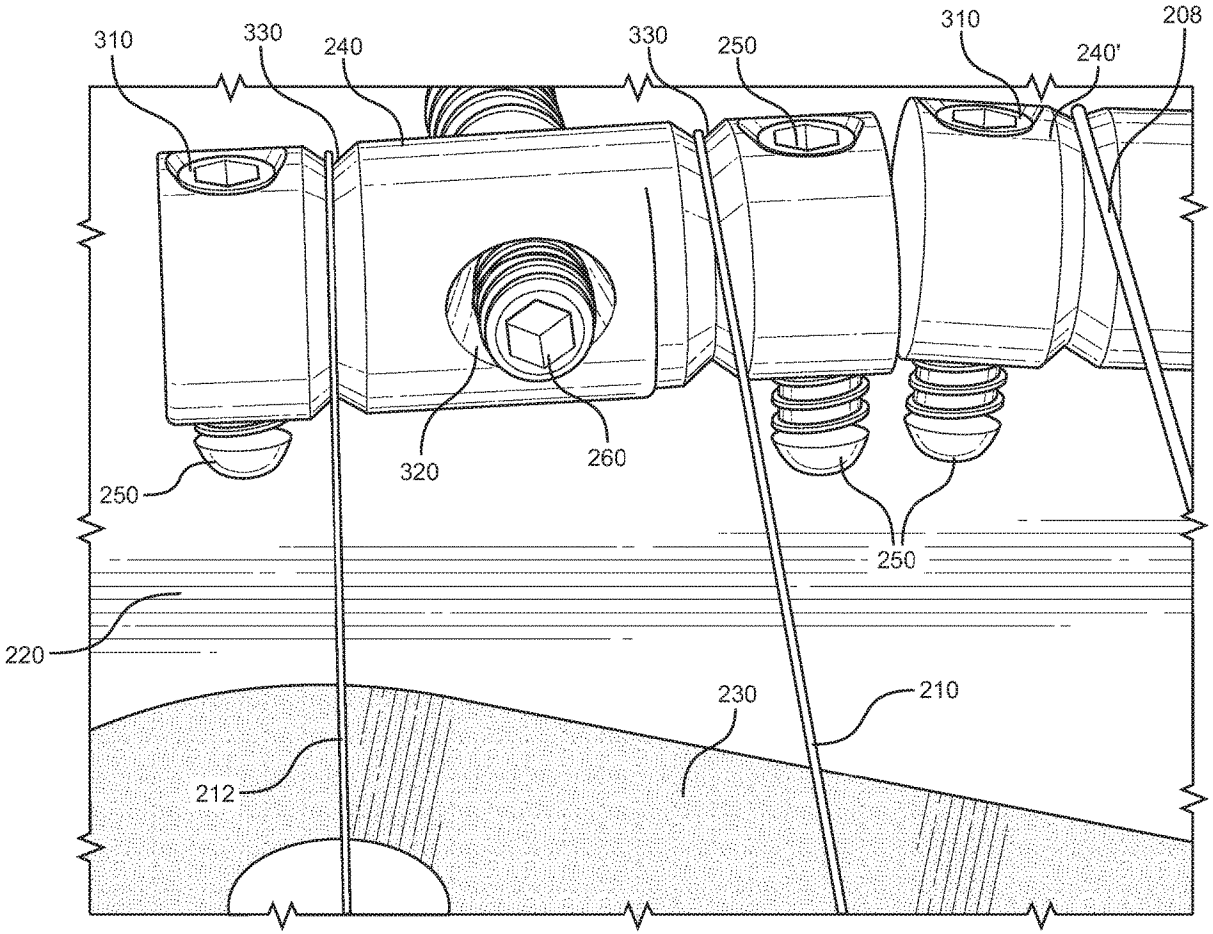
FIG. 6 depicts a close-up view of exemplary offset compensated telecaster (or tele) saddles with strings passing there over in accordance with aspects of the present disclosure.

FIG. 6 depicts a close-up view of exemplary offset compensated telecaster (or tele) saddles 240, 240' with strings 212, 210, 208 passing there over in accordance with aspects of the present disclosure. As shown in FIG. 6, the height adjustment screws 250 are arranged in the height adjustment holes 310, and are used to adjust a height of the saddle 240 above the guitar (or bridge mounting plate 220). That is, as shown in FIG. 6, the height adjustment screws 250 contact the bridge mounting plate 220, such that, as the height adjustment screws 250 are rotated, the height of the respective sides of the saddle are moved upwardly or downwardly relative to the guitar (or bridge mounting plate 220). It should be understood that the height of each end of a respective saddle may be adjusted differently with the height adjustment screws 250, such that the saddle is oriented in a non-parallel manner relative to the guitar (or bridge mounting plate 220). In such a manner, the string height for each string supported by a respective saddle can be optimally set.

As shown in FIG. 6, the length adjustment screw 260 is arranged in the length adjustment hole 320, and is used to adjust a longitudinal position of the saddle 240 on the guitar (or bridge mounting plate 220). In such a manner, the length adjustment screw 260 may be used to adjust a string length between the saddle and nut, so as to properly intonate the strings of the guitar.

FIG. 6 also depicts the strings (e.g., strings 212, 210, and 208) passing over respective v-grooves (or notches) 330 in the saddles 240. As also shown in FIG. 6, the strings (e.g., strings 212, 210, and 208) are arranged to pass over the pickup 230.

Figure 7:
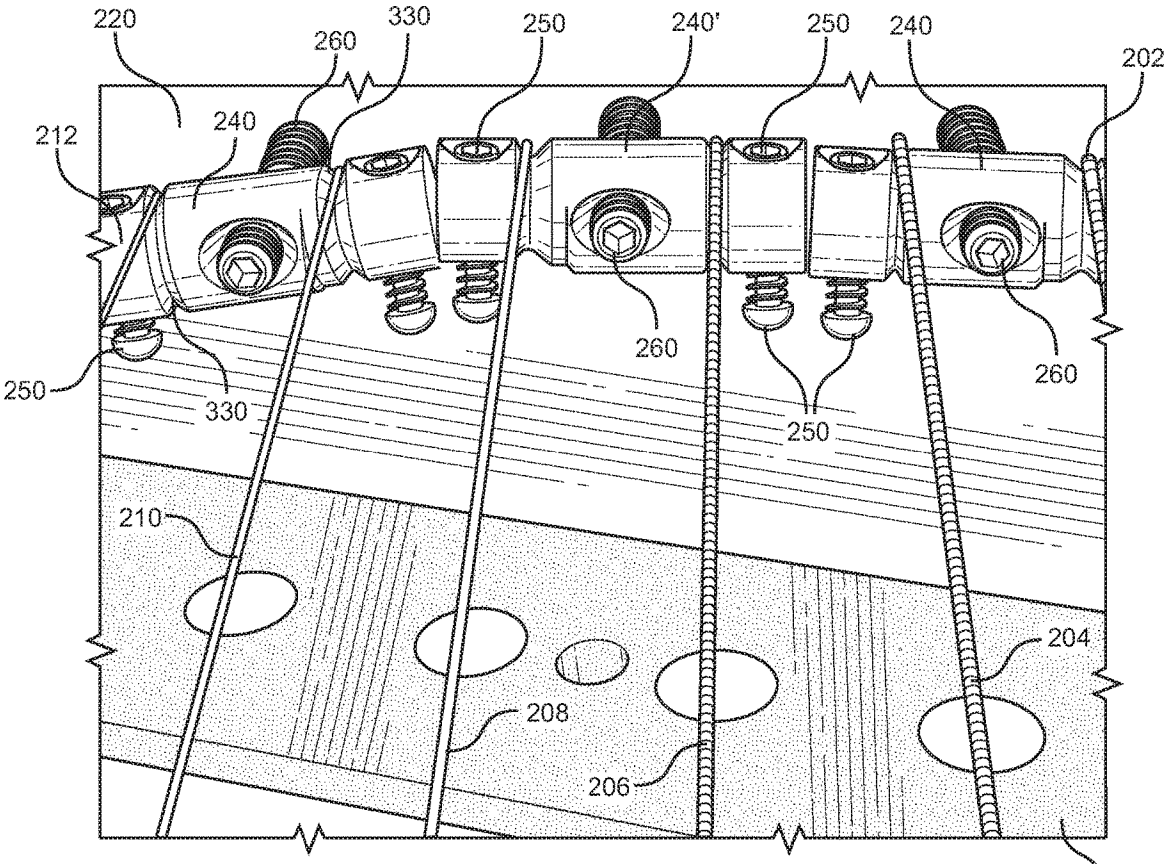
FIG. 7 depicts another close-up view of exemplary offset compensated telecaster (or tele) saddles with strings passing there over and then over a pickup in accordance with aspects of the present disclosure.

FIG. 7 depicts another close-up view of exemplary offset compensated telecaster (or tele) saddles 240 with strings passing there over and then over a pickup 230 in accordance with aspects of the present disclosure. As shown in FIG. 7, the height adjustment screws 250 are arranged in respective height adjustment holes 310, and are used to adjust a height of the saddle 240 above the guitar (or bridge mounting plate 220). As shown in FIG. 7, each end of a respective saddle 420 may be adjusted differently with the height adjustment screws 250, such that the saddle 420 may be oriented in a non-parallel manner relative to the guitar (or bridge mounting plate 220). As shown in FIG. 7, the leftmost saddle 240 is oriented in a non-parallel (or tilted) manner, whereas the center saddle 240' is arranged approximately parallel to the guitar (or bridge mounting plate 220), In such a manner, the string height for each string supported by a respective saddle can be optimally set.

As shown in FIG. 7, the length adjustment screw 260 is arranged in the threaded length adjustment hole 320, and is used to adjust a longitudinal position of the saddle 240 on the guitar (or bridge mounting plate 220). FIG. 7 also depicts the strings (e.g., strings 202, 204, 206, 208, 201, and 212) passing over respective v-grooves 330 in the respective saddles 240.

Figure 8:
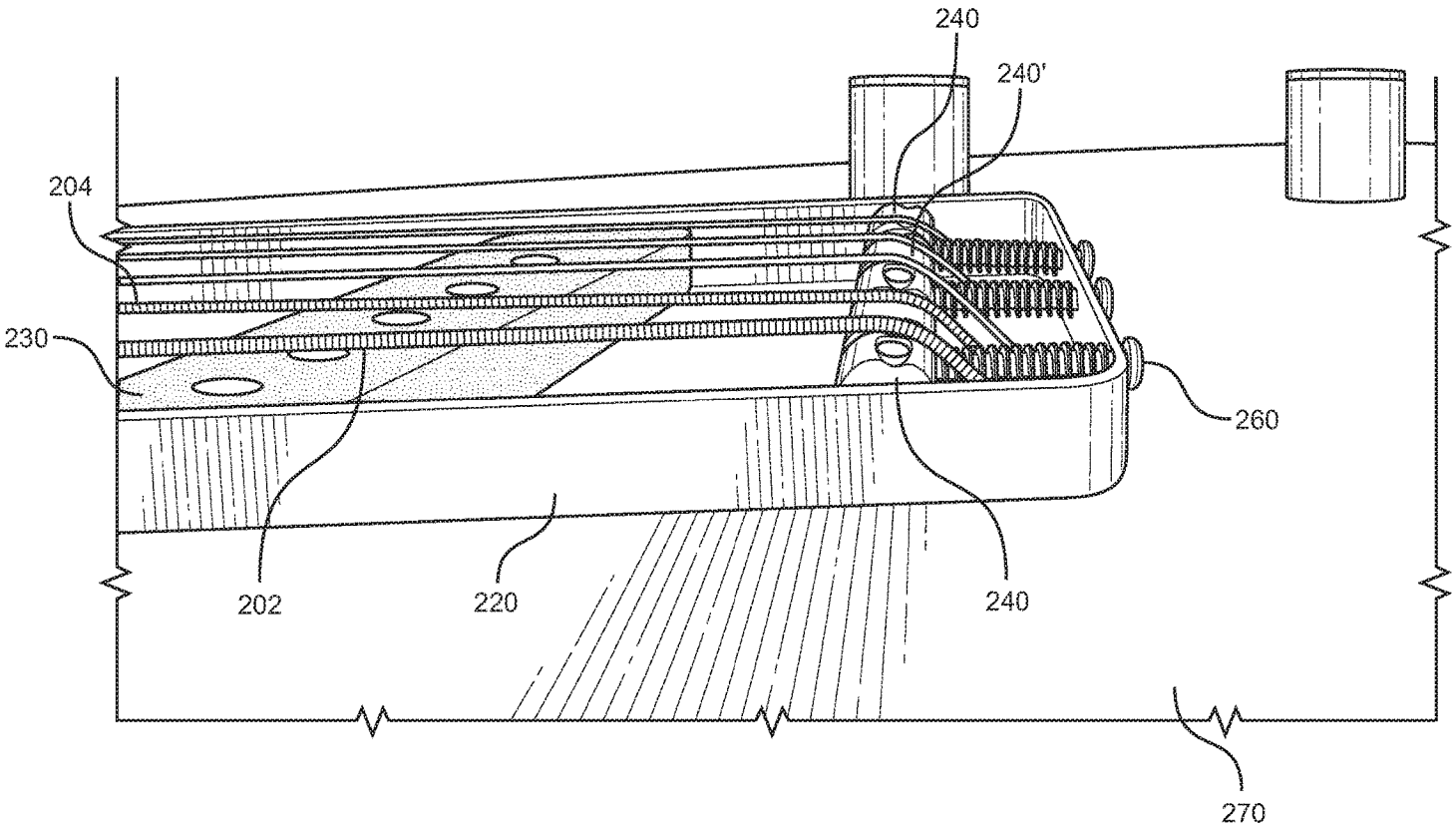
FIG. 8 depicts a side view of an exemplary tele-style bridge having offset compensated telecaster (or tele) saddles with strings passing there over in accordance with aspects of the present disclosure.

FIG. 8 depicts a side view of an exemplary tele-style bridge 220 mounted to a guitar 270, and having offset compensated telecaster (or tele) saddles 240, 240' with strings (e.g., 202, 204) passing there over in accordance with aspects of the present disclosure. As shown in the side view of FIG. 8, the length adjustment screw 260 passes through the bridge 220 (or bridge plate) and through the threaded length adjustment hole 320, and is used to adjust a longitudinal position of the respective saddle 240 on the guitar (or bridge mounting plate 220). FIG. 8 also shows the strings are arranged to pass over the pickup 230.

Figure 9:
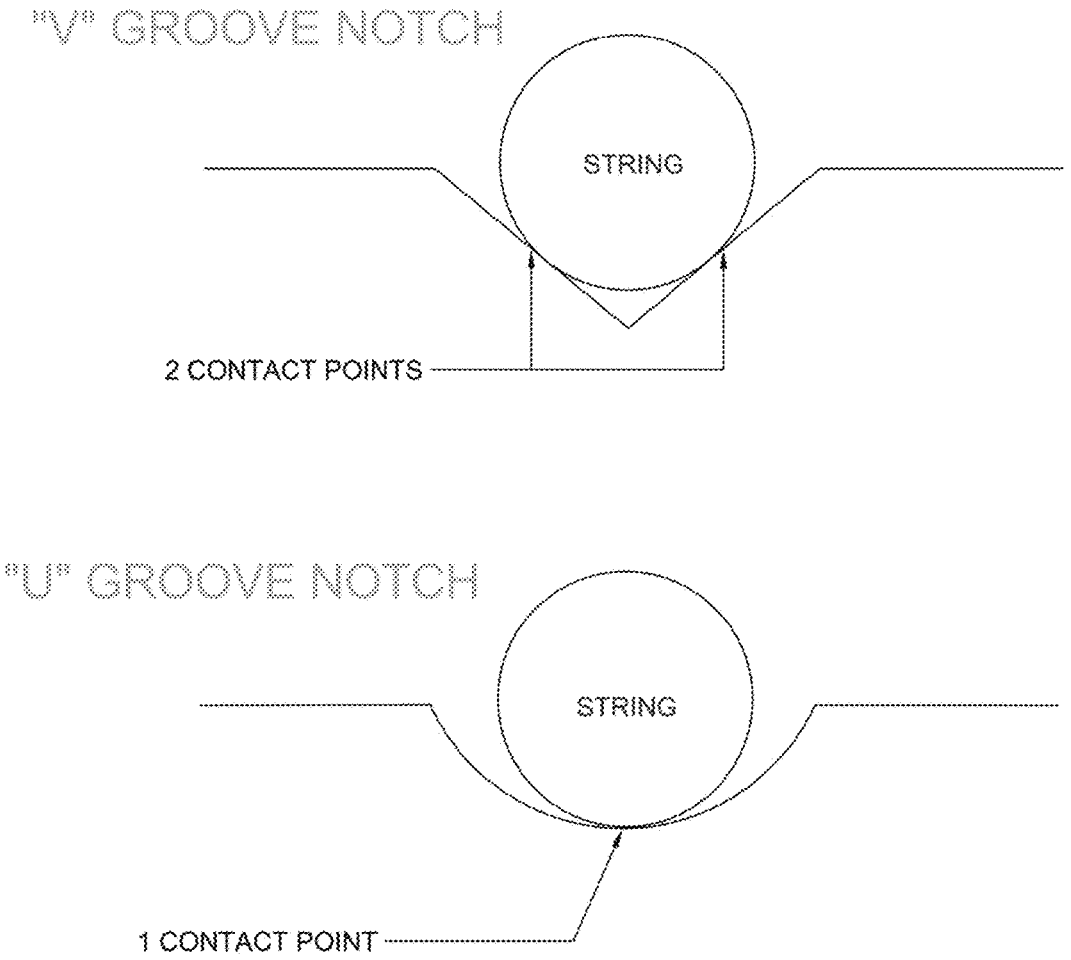
FIG. 9 shows a comparison between a u-groove notch and a v-groove notch in accordance with aspects of the present disclosure.

FIG. 9 shows a comparison between a u-groove notch and a v-groove notch in accordance with aspects of the present disclosure. As noted above, in embodiments of the present invention, the grooves 330 on the saddles 240 have a v-groove notch shape. As shown in the schematic depiction of a v-groove notch in FIG. 9, when a string is arranged in the v-groove notch, the v-groove notch provides two points of contact with the string. In contrast, a u-shaped groove notch provides only one point of contact with a string arranged therein. In accordance with aspects of the disclosure, with the two contact points and the fact that the string break angle is along a curve and not an edge, when the saddle is raised to compensate for a shallow neck set (meaning the neck sits higher on the body) or back-pitched neck, a secure contact is maintained between the string and the saddle 240. Another benefit of the design of the v-shaped groove notch is that strings sustain longer and have more of a weight to single notes, meaning they do not have as much random harmonics, since the string is sitting more securely in the saddle. Thus, while embodiments of the present disclosure may utilize a u-shaped groove notch, in accordance with aspects of the disclosure, a v-shaped groove notch provides a more secure contact for the string. Thus, by utilizing such a v-shaped groove notch, the string is more effectively retained in the notch of the saddle.

When using tremolo systems or b-bender systems (which increase and decrease tension on a string by manipulating the string from behind the saddle) with telecasters, the systems may need more guidance for the string path. With conventional saddles, while playing when the tension is low (e.g., the b-bender system is not engaged), the strings can shift out of place. In accordance with aspects of the disclosure, with the present embodiments, the v-shaped groove holds the strings more securely such that they do not shift out of place when using tremolo systems or b-bender systems. In accordance with further aspects of the disclosure, the string moves smoothly across the saddle 240 and stays where it should (i.e., in its respective notch). Moreover, with the present embodiments, in accordance with aspects of the disclosure, since the weight distribution of the string is distributed between two points rather than one focal point, saddle wear is very minimal, if any, as compared to other saddle designs having a single focal point.

Figure 10:
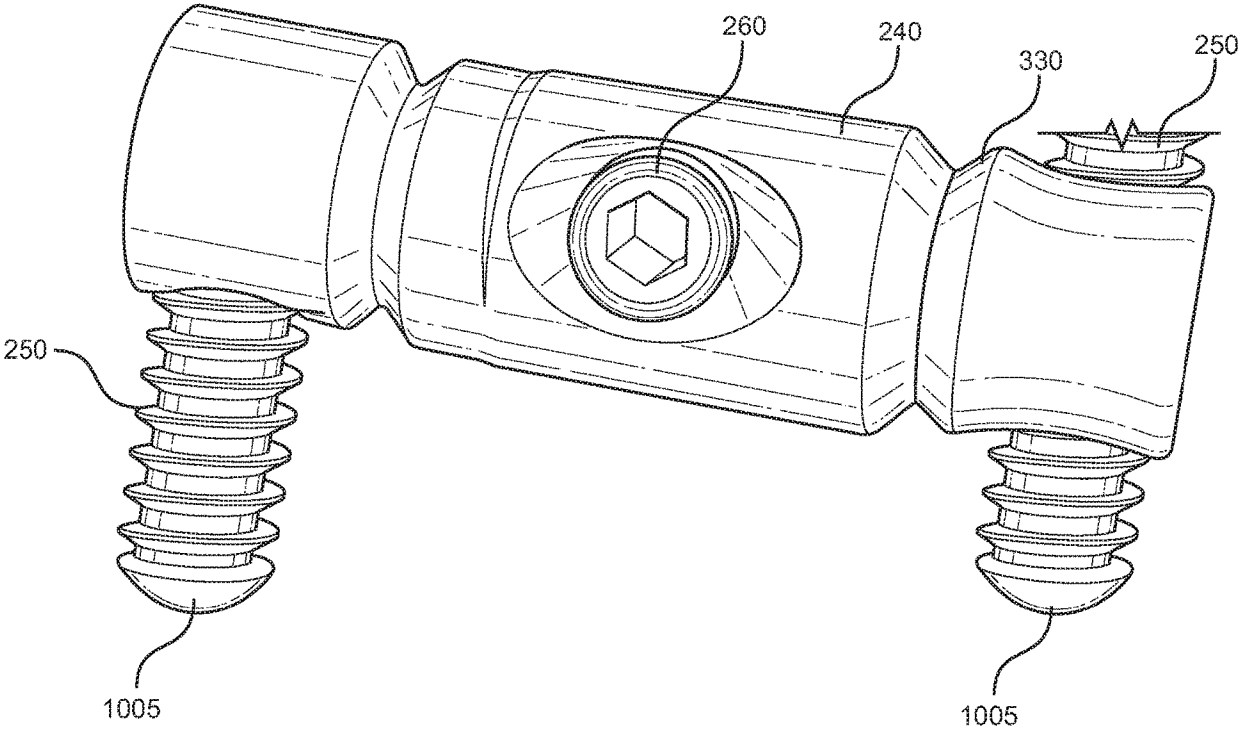
FIG. 10 illustrates a view of an exemplary offset compensated telecaster (or tele) saddle with the height adjustment screws having a rounded tip in accordance with aspects of the present disclosure.

FIG. 10 illustrates a view of an exemplary offset compensated telecaster (or tele) saddle 240 with the height adjustment screws 250 having a rounded tip 1005 in accordance with aspects of the present disclosure. FIG. 10 also shows the length adjustment screw 260, and v-shaped groove notches 330. As noted above, the saddles 240 may be mounted to the guitar in a non-parallel manner through adjustment of the height adjustment screws 250 of the saddle. In accordance with aspects of the disclosure, the saddles 240 utilize height adjustment screws 250 having a rounded tip 1005. The rounded tip 1005 is structured and arranged to contact the mounting plate so as to position the saddle at a desired height. In accordance with aspects of the disclosure, by utilizing height adjustment screws 250 having a rounded tip 1005, the rounded tip 1005 is operable to provide a large surface contact area between the height adjustment screws 250 and the mounting plate through a range of angled orientations. That is, by providing a radius (or rounded tip 1005) the bottom of the height adjustment screws 250 (e.g., to reflect the angle which the saddle would sit at), when the screws 250 sit on (or contact) the plate, the connection transfers more energy from the string to the bridge plate because the height adjustment screws 250 are not sitting on a razors edge.

Figure 11A:
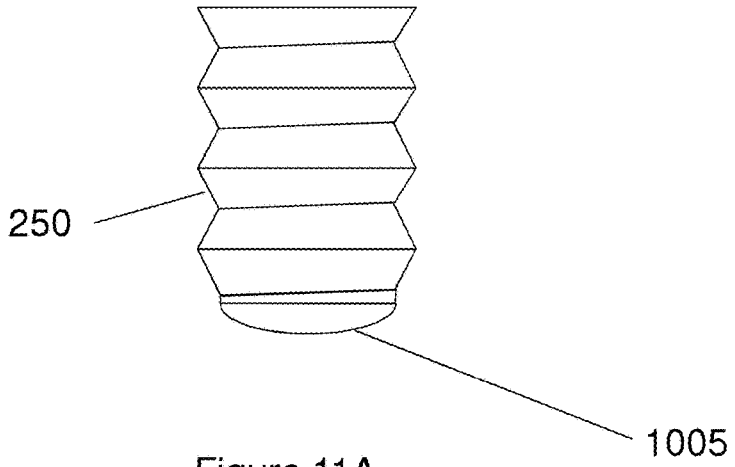
FIG. 11A illustrates a height adjustment screw having a rounded (or curved) tip in accordance with aspects of the present disclosure.

FIG. 11A illustrates a schematic drawing of a height adjustment screw 250 having a rounded (or curved) tip 1005 in accordance with aspects of the present disclosure.

Figure 11B:
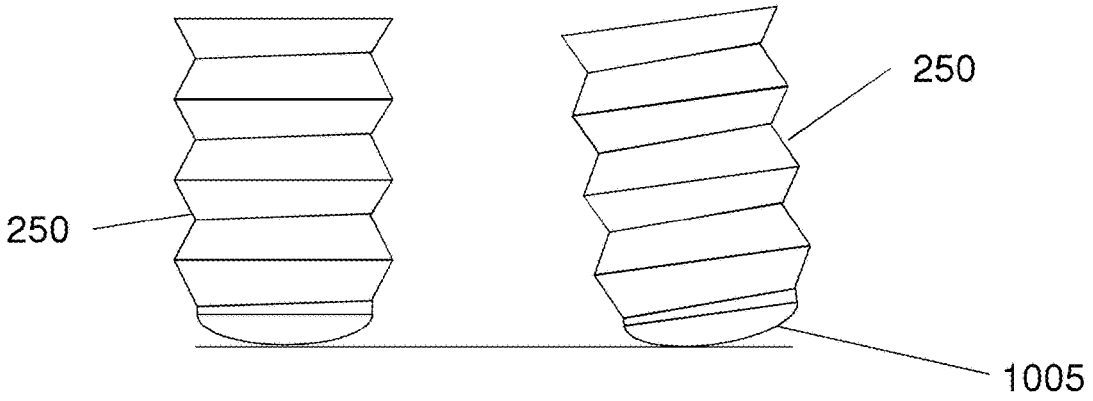
FIG. 11B illustrates a height adjustment screw having a rounded (or curved) tip in a vertical orientation relative to a contact surface and at a tilted orientation relative to a contact surface in accordance with aspects of the present disclosure.

FIG. 11B illustrates the height adjustment screw 250 having a rounded (or curved) tip 1005 in in a vertical orientation (left-side) relative to a contact surface (e.g., a bridge mounting plate) and at a tilted orientation (right-side) relative to a contact surface in accordance with aspects of the present disclosure. As shown in comparing these two arrangements, in accordance with aspects of the disclosure, the rounded tip 1005 is operable to provide a large surface contact area between the height adjustment screws 250 and the mounting plate through a range of angled orientations. In such a manner, the rounded tip 1005 of the height adjustment screw 250 is able to provide a more secure and stable connection between the saddles 240 and the guitar.

Figure 12:
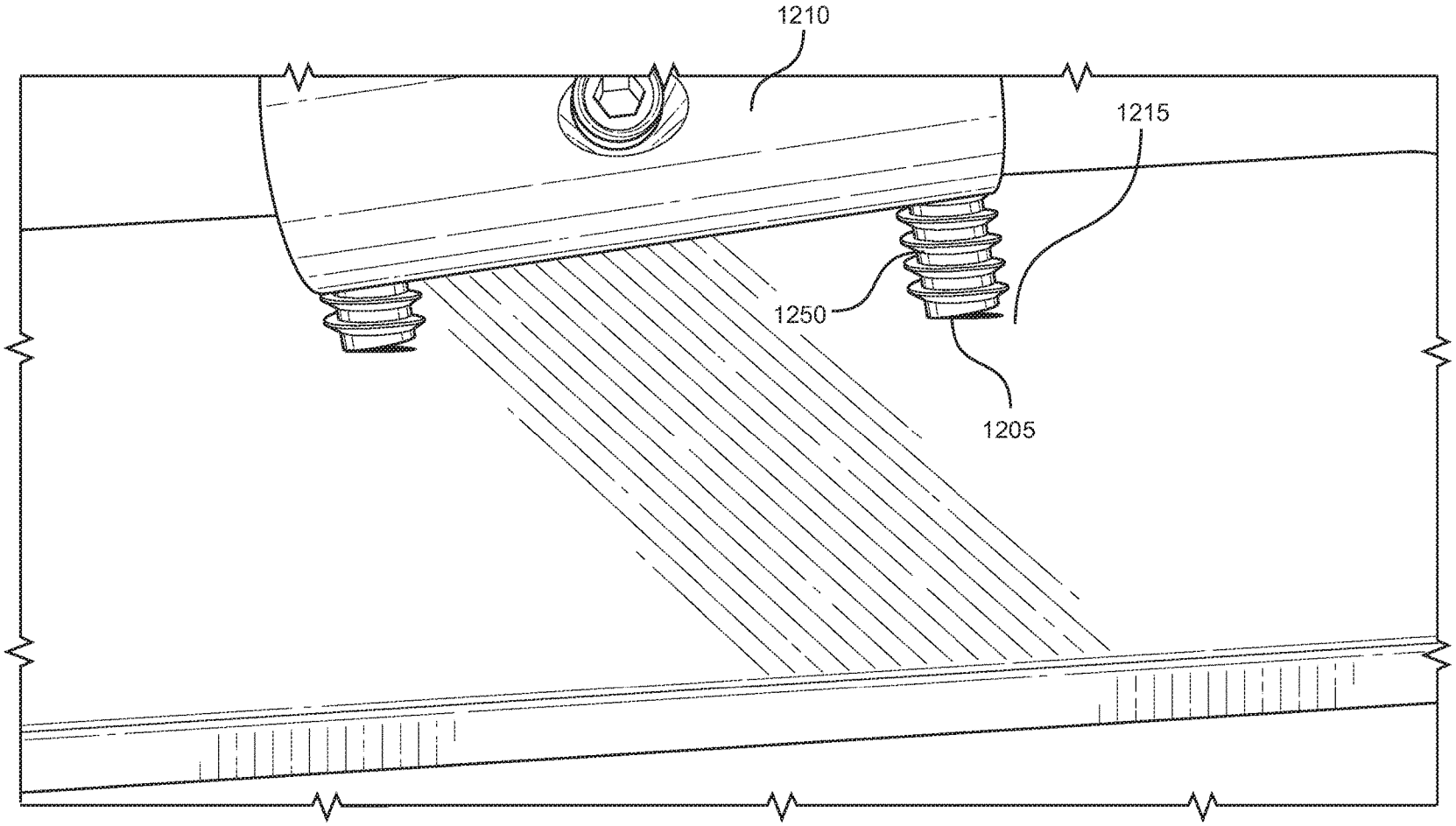
FIG. 12 PRIOR ART
FIG. 12 illustrates a view of a conventional saddle with a standard set screw height adjustment screw.

FIG. 12 illustrates a view of a conventional saddle 1210 with a standard set screw height adjustment screw 1250, having a flat tip 1205. It should be observed that the conventional saddle 1210 is merely a uniform cylinder, in contrast to the asymmetrical grooved offset saddle of the present disclosure. Conventional saddles utilize flat or cupped set screws. When the saddles are attached to the guitar using flat or cupped set screws, the tips of these flat or cupped set screws dig into the bridge and do not sit securely on the bridge. Moreover, with these conventional saddles, if tension is not even on both sides of the saddles, this unbalanced tension can cause undesirable buzzing or rattling.

As also observable in FIG. 12, when the saddle 1210 is arranged in a non-parallel manner (i.e., relative to a mounting surface) the flat tip 1205 prevents a large surface contact area between the height adjustment screws 1250 and a mounting surface. That is, when the standard set screw height adjustment screw 1250 is tilted from its vertical orientation (as depicted in FIG. 12), the standard set screw height adjustment screw 1250 is tipped on its edge, such that only a small contact area is achievable. As shown in FIG. 12, this small contact area results in a significant gap 1215 between the height adjustment screw 1250 and the mounting surface, and consequently, the standard set screw height adjustment screw 1250 provide a less secure and less stable connection between the saddle 1210 and the guitar. Moreover, the more the height adjustment screw 1250 is tilted, the larger the gap 1215 between the height adjustment screw 1250 and the mounting surface becomes.

Figure 13A:
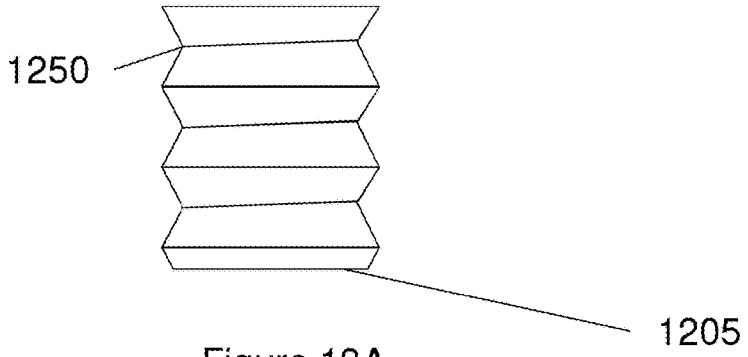
Figure 13A (Prior Art)
FIG. 13A illustrates a standard set screw height adjustment screw having a conventional flat tip.

FIG. 13A illustrates a standard set screw height adjustment screw 1250 having a conventional flat tip 1205.

Figure 13B:
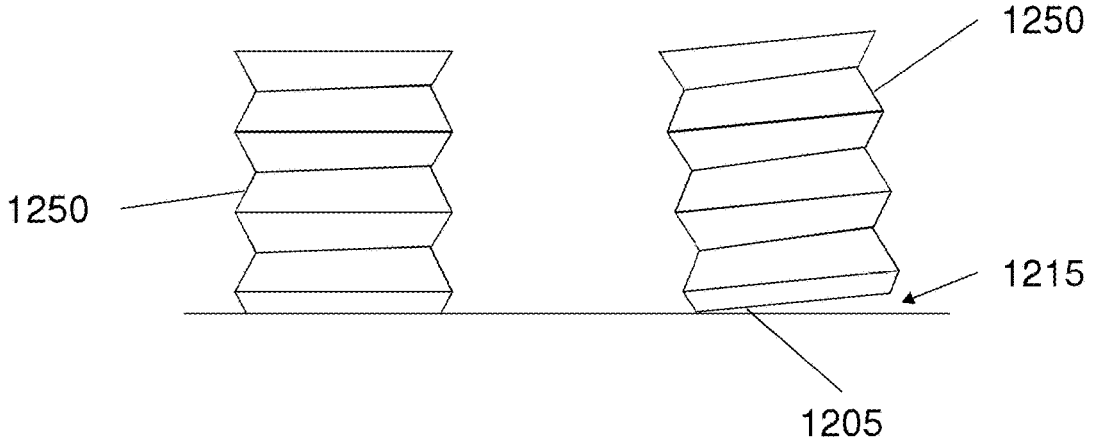
Figure 13B (Prior Art)
FIG. 13B illustrates a standard set screw height adjustment screw having a conventional flat tip in in a vertical orientation relative to a contact surface and at a tilted orientation relative to a contact surface.

FIG. 13B illustrates a standard set screw height adjustment screw 1250 having a conventional flat tip 1205 in in a vertical orientation (left-side) relative to a contact surface, and at a tilted orientation (right-side) relative to a contact surface. As shown in comparing these two arrangements, the flat tip 1205 while providing a sufficient contact surface when oriented vertically, only provides a small area of contact (e.g., an edge contact) when the height adjustment screw 1250 is orientated in an angled manner. In such a manner, the standard set screw height adjustment screw 1250 provides a less secure and less stable connection between the saddle 1210 and the guitar.

In contrast, with the height adjustment screw 250 of the present disclosure, having the rounded tip 1005, a much more secure contact can connection with the guitar is achievable over a large range of orientations. Moreover, in contrast to the height adjustment screw 1250, wherein the more it is tilted, the larger the gap 1215 between the height adjustment screw 1250 and the mounting surface becomes, with the with the height adjustment screw 250 of the present disclosure, due to the rounded tip 1005, the amount of contact with the guitar is approximately the same regardless of the orientation of the height adjustment screw 250 (within a range of tilting).

Figure 14:
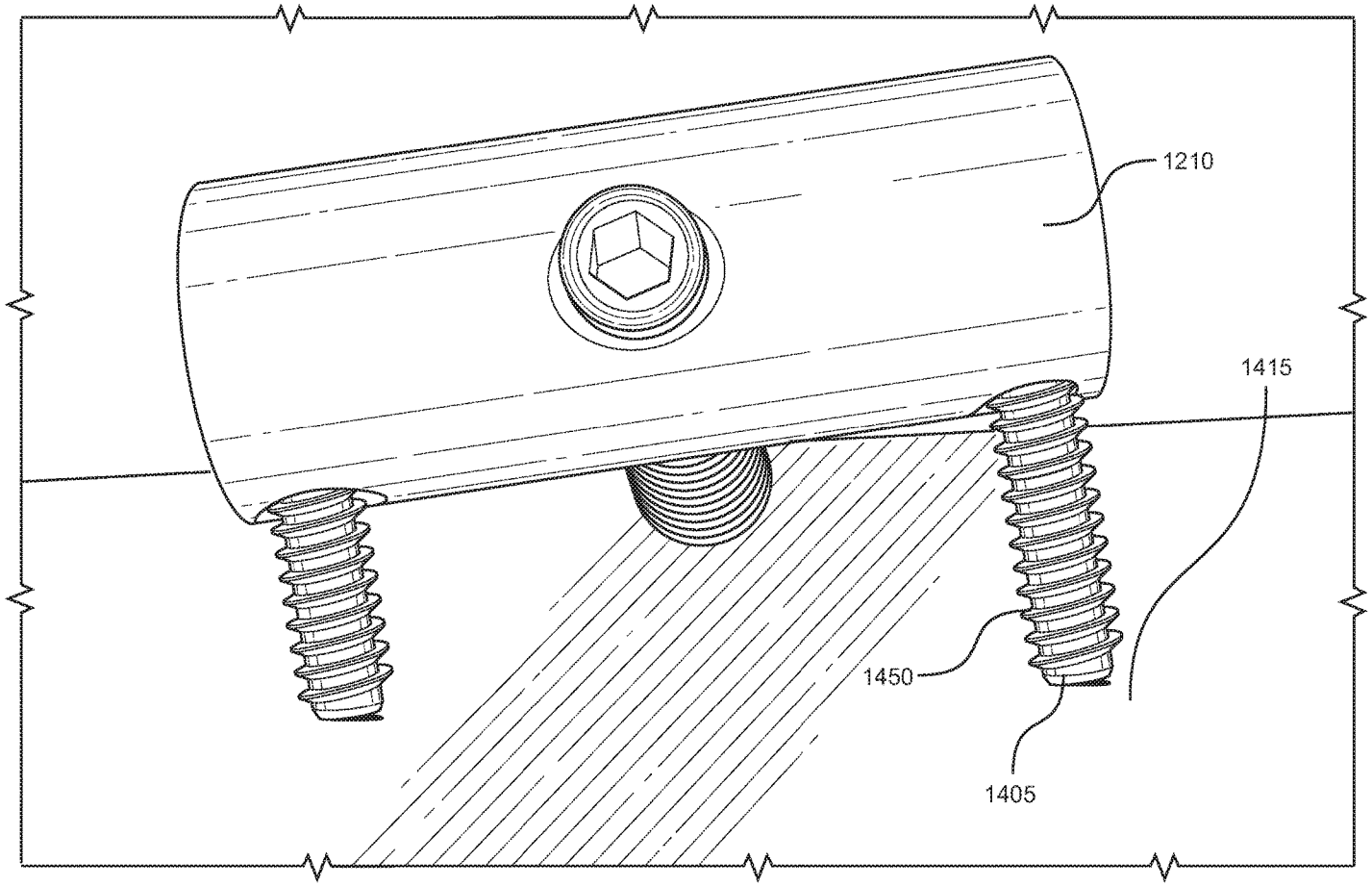
FIG. 14 PRIOR ART
FIG. 14 illustrates a view of a conventional saddle with a cupped set screw height adjustment screw.

FIG. 14 illustrates a view of a conventional saddle 1210 with a cupped set screw height adjustment screw 1450. As observable in FIG. 14, when the saddle 1210 is arranged in a non-parallel manner (i.e., relative to a mounting surface) the flat tip 1405 prevents a large surface contact area between the height adjustment screws 1450 and a mounting surface. That is, when the cupped set screw height adjustment screw 1450 is tilted from its vertical orientation (as depicted in FIG. 14), the cupped set screw height adjustment screw 1450 is tipped on its edge, such that only a small contact area is achievable. As shown in FIG. 14, this small contact area results in a significant gap 1415 between the height adjustment screw 1450 and the mounting surface, and consequently, the cupped set screw height adjustment screw 1450 provide a less secure and less stable connection between the saddle 1210 and the guitar. Moreover, the more the height adjustment screw 1450 is tilted, the larger the gap 1415 between the height adjustment screw 1450 and the mounting surface becomes.

Figure 15A:
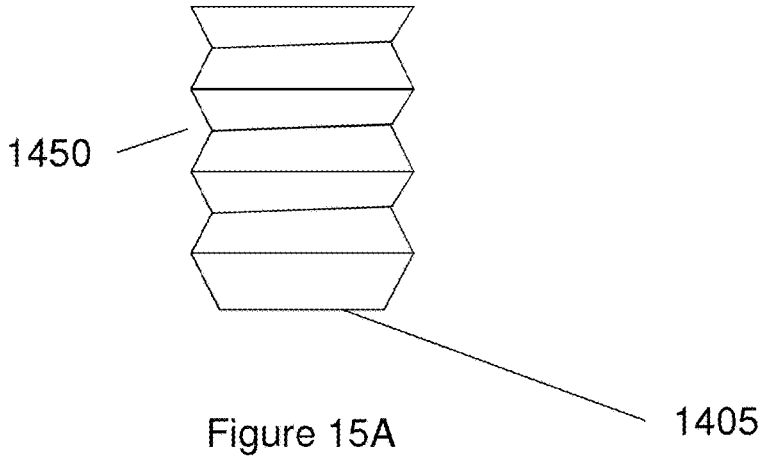
Figure 15A (Prior Art)
FIG. 15A illustrates a cupped set screw height adjustment screw having a conventional flat tip.

FIG. 15A illustrates a cupped set screw height adjustment screw 1450 having a conventional flat tip 1405.

Figure 15B:
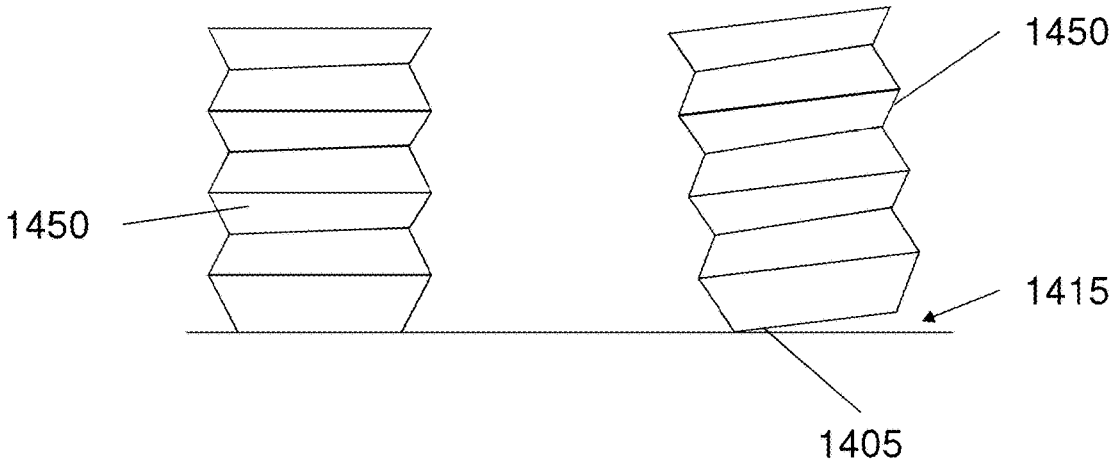
Figure 15B (Prior Art)
FIG. 15B illustrates a height adjustment screw having a conventional flat tip in in a vertical orientation relative to a contact surface and at a tilted orientation relative to a contact surface.

FIG. 15B illustrates a cupped set screw height adjustment screw 1450 having a conventional flat tip 1405 in a vertical orientation (left-side) relative to a contact surface and at a tilted orientation (right-side) relative to a contact surface. As shown in comparing these two arrangements, the flat tip 1405 while providing a sufficient contact surface when oriented vertically, only provides a small area of contact (e.g., an edge contact) when the height adjustment screw 1450 is orientated in an angled (or tilted) manner. As such, the standard set screw height adjustment screw 1450 provides a less secure and less stable connection between the saddle 1210 and the guitar. In contrast, with the height adjustment screw 250 having the rounded tip 1005 of the present disclosure, a much more secure contact can connection with the guitar is achievable over a large range of orientations.

Moreover, in contrast to the height adjustment screw 1450, wherein the more it is tilted, the larger the gap 1415 between the height adjustment screw 1450 and the mounting surface becomes, with the with the height adjustment screw 250 of the present disclosure, due to the rounded tip 1005, the amount of contact with the guitar is approximately the same regardless of the orientation of the height adjustment screw 250 (within a range of tilting).

The components described herein are also designed to fit or retrofit most instruments without any modification to the original instrument. Even expensive "vintage" instruments can be fitted with the new components without any modification to the instrument, and the use of the new components does not detract from the "vintage" look of the instrument. The new components may be constructed to make visual detection of any difference between original stock components and the new components difficult. The new components are easy to use, install, and adjust by a purchaser. A professional installation and adjustment of the components is likely not needed after the first such installation and adjustment, as the instrument owner or user can perform the installation and maintenance.

In accordance with aspects of the disclosure, manufacturing the saddles 240 requires several different operations. The saddles start with a raw rod stock of metal (e.g., brass, aluminum, or steel). For example, the ¼" saddles (e.g., as shown in FIG. 3A) begin as a 0.312" diameter stock, and the 5⁄16" saddles (e.g., as shown in FIG. 5) begins as a 0.375" diameter stock. In accordance with aspects of the disclosure, each end of the saddle is then machined on a CNC machine to form the asymmetrical shape. Grooves (e.g., V-grooves are added to the machined saddle, and then holes (i.e., vertical adjustment holes 310 and longitudinal adjustment hole 320) are drilled, counter sunk and tapped. The saddles 240 are then assembled with two set screws (or height adjustment screws 250), one spring and one intonation screw (or length adjustment screw 260) and packaged in groups of three with the set screws in the proper direction (with one reversed) to make a full set of saddles. The saddle may also be formed using other methods, for example, including die-casting or 3D printing, amongst other contemplated manufacturing methods.

While the disclosure describes the saddles as having universally sized grooves (so that one saddle design may be used to support different string gauges) and thus simplify manufacturing, in embodiments, the saddles may utilize string-specific grooves. In accordance with an aspect of the disclosure, in embodiments, a bridge may be provided with string-specific saddles, in which each saddle has two notches sized to accommodate a specific string size (or range of sizes). By implementing this aspect of the present disclosure, the bridge having string-specific saddles further improves contact area between each string and its respective saddle, and provides better string stability giving the artist better feel during use. Additionally, string-specific saddles may further eliminate buzz that occurs from poor string to saddle contact area, and eliminate the loose feel of chords.

In accordance with aspects of the disclosure, the string-specific saddle helps prevent poor string alignment to the pick-up. That is, as each saddle is string-specific, each string is more properly aligned with the pick-up, e.g., laterally (or along the bridge direction) and vertically above the pick-up. The string-specific notches help to maintain each string in its proper position, e.g., during playing when additional force is applied to the strings. For example, embodiments of the present disclosure help to prevent string jump, because strings fit precisely into their respective saddles. Constant string position improves performance and reliability of the guitar.

Additionally, embodiments of the present disclosure provide more precise height of string to pick-up distances for each of the strings for precise tuning. For example, in embodiments, the saddles and the notches can be configured such that all the strings are positioned to provide an equal distance from bottom of each respective string to the pick up. Additionally, for example, the saddles and the notches can be configured such that the strings are positioned to provide an equal distance from bottom of each respective string to the fret board. As is understood by those of ordinary skill in the art, the fret board may have a radius of curvature, such that the outer two strings (e.g., the "high-E" and the "low-E" strings) are slightly lower (i.e., closer to the pick up) than the two center strings (e.g., the "D" string and the "G" string), with the height of the two intermediate strings (e.g., the "A" string and the "B" string) positioned at a height between the other two pairs of strings. Additionally, the saddles and the notches can be configured such that the pairs of corresponding strings (i.e., the "high-E" and the "low-E" strings, the "D" string and the "G" string, and the "A" string and the "B" string) are positioned at the same height relative to one another.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel configuration is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the disclosure refers to specific embodiments, those skilled in the art will understand that various changes may be made and equivalents may be substituted for elements thereof without departing from the true spirit and scope of the embodiments of the disclosure. While exemplary embodiments are described above, it is not intended that these embodiments describe all possible forms of the invention. Rather, the words used in the specification are words of description rather than limitation, and it is understood that various changes may be made without departing from the spirit and scope of the disclosure. In addition, modifications may be made without departing from the essential teachings of the disclosure. Furthermore, the features of various implementing embodiments may be combined to form further embodiments of the disclosure.

What is claimed is:

1. A stringed-instrument saddle, comprising:

two string paths, wherein each string path is configured to accommodate a string, and wherein the two string paths are offset from one another by an offset distance in a direction of string extension, the saddle further comprising a first approximately-cylindrical portion and a second approximately-cylindrical portion, wherein the first approximately-cylindrical portion is offset from the second approximately-cylindrical portion by the offset distance, and wherein the offset distance is approximately 0.043 inches.

2. The stringed-instrument saddle of claim 1, wherein the stringed-instrument saddle extends in a longitudinal direction, which is perpendicular to the direction of string extension, the stringed-instrument saddle further comprising two threaded height adjustment holes arranged on respective ends of the stringed-instrument saddle beyond respective string paths in the longitudinal direction.

3. The stringed-instrument saddle of claim 2, further comprising a threaded length adjustment hole arranged between the two string paths in the longitudinal direction.

4. The stringed-instrument saddle of claim 3, wherein the two threaded height adjustment holes are perpendicular to the threaded length adjustment hole.

5. The stringed-instrument saddle of claim 1, wherein the first approximately-cylindrical portion comprises a first threaded height adjustment hole and the second approximately-cylindrical portion comprises a second threaded height adjustment hole.

6. The stringed-instrument saddle of claim 1, further comprising an approximately oval cylindrical portion arranged between the first approximately-cylindrical portion and the second approximately-cylindrical portion.

7. The stringed-instrument saddle of claim 6, wherein the approximately oval cylindrical portion has a height equal to the diameter of the first and second approximately-cylindrical portions and has a width equal to the diameter of the first and second approximately-cylindrical portions plus the offset distance.

8. The stringed-instrument saddle of claim 6, wherein the approximately oval cylindrical portion comprises a threaded length adjustment hole.

9. The stringed-instrument saddle of claim 1, wherein the offset distance is operable to provide string intonation compensation for accommodated strings.

10. A bridge assembly comprising three stringed-instrument saddles of claim 1, wherein two of the stringed-instrument saddles are arranged in a same offset orientation, and a third of the stringed-instrument saddles is arranged with an opposite offset orientation between the two of the stringed-instrument saddles.

11. The stringed-instrument saddle of claim 1, wherein height adjustment holes are offset from one another in the direction of string extension direction by the offset distance.

12. The stringed-instrument saddle of claim 1, wherein the first approximately-cylindrical portion and the second approximately-cylindrical portion each have a diameter of approximately 0.247 inches.

13. The stringed-instrument saddle of claim 1, wherein the first approximately-cylindrical portion and the second approximately-cylindrical portion each have a diameter of approximately 0.313 inches.

14. The stringed-instrument saddle of claim 1, wherein a first string path of the two string paths is arranged on the first approximately-cylindrical portion and a second string path of the two string paths is arranged on the second approximately-cylindrical portion.

15. A stringed-instrument saddle, comprising:

two string paths, wherein each string path is configured to accommodate a string, and wherein the two string paths are offset from one another by an offset distance in a direction of string extension, wherein the two string paths each comprise a v-shaped groove, and wherein a depth of the groove is approximately 0.027 inches.

16. The stringed-instrument saddle of claim 15, further comprising a first approximately-cylindrical portion and a second approximately-cylindrical portion, wherein the first approximately-cylindrical portion is offset from the second approximately-cylindrical portion by the offset distance.

17. The stringed-instrument saddle of claim 16, wherein a first string path of the two string paths is arranged on the first approximately-cylindrical portion and a second string path of the two string paths is arranged on the second approximately-cylindrical portion.

18. The stringed-instrument saddle of claim 16, wherein the first approximately-cylindrical portion and the second approximately-cylindrical portion each have a diameter of approximately 0.247 inches.

19. The stringed-instrument saddle of claim 16, wherein the first approximately-cylindrical portion and the second approximately-cylindrical portion each have a diameter of approximately 0.313 inches.

20. The stringed-instrument saddle of claim 15, wherein the offset distance is approximately 0.043 inches.

21. The stringed-instrument saddle of claim 15, wherein the groove is formed around an entire perimeter of the saddle and wherein the depth of the groove is constant around the entire perimeter of the saddle.

22. A stringed-instrument saddle, comprising:

two string paths, wherein each string path is configured to accommodate a string, and wherein the two string paths are offset from one another by an offset distance in a direction of string extension, wherein the stringed-instrument saddle extends in a longitudinal direction, which is perpendicular to the direction of string extension, the stringed-instrument saddle further comprising two threaded height adjustment holes arranged on respective ends of the stringed-instrument saddle beyond respective string paths in the longitudinal direction and a height adjustment screw arranged in each of the two threaded height adjustment holes, wherein the height adjustment screw comprises a rounded-tip end configured for contact with a surface of a stringed-instrument or a bridge plate arrangable on a stringed-instrument and is operable to provide an approximately constant amount of contact with the surface of the stringed-instrument or the bridge plate through a range of saddle orientation angles.

* * * * *